US006016634A

United States Patent [19]

Sayer

[11] Patent Number: 6,016,634

[45] Date of Patent: Jan. 25, 2000

[54] FABRICATED STRUCTURE, ESPECIALLY A HOUSING FOR A GENERATOR SET, AND A METHOD OF FABRICATING SUCH A STRUCTURE

[75] Inventor: Raymond Sayer, Stokenchurch, United Kingdom

[73] Assignee: Cummins Power Generation Limited, Ramsgate, United Kingdom

[21] Appl. No.: 08/687,817

[22] Filed: Jul. 26, 1996

[51] Int. Cl.[7] ..... E04H 1/06; A47B 43/00

[52] U.S. Cl. ..... 52/648.1; 52/649.2; 52/79.1; 312/265.1; 312/311

[58] Field of Search ..... 52/648.1, 649.2, 52/664–669, 582.1, 736.1, 736.2, 737.2, 731.9, 79.1, 79.7, 241; 312/265.1, 265.4, 311; 403/252, 255, 231, 219

[56] References Cited

U.S. PATENT DOCUMENTS

| | | | |
|---|---|---|---|
| 1,970,965 | 8/1934 | Leake . | |
| 2,058,263 | 10/1936 | Rosendale | 312/265.4 |
| 3,265,419 | 8/1966 | Durnbaugh et al. | 403/219 |
| 3,561,633 | 2/1971 | Morrison | 220/4 X |
| 3,717,964 | 2/1973 | Brown et al. | 52/690 X |
| 3,834,575 | 9/1974 | Carr | 220/4 X |
| 4,004,856 | 1/1977 | Wesseler | 403/252 X |
| 4,522,009 | 6/1985 | Fingerson | 52/667 |
| 4,944,421 | 7/1990 | Yurgevich | 220/1.5 |
| 5,433,501 | 7/1995 | Thomas et al. | 52/731.6 X |
| 5,458,428 | 10/1995 | West | 403/252 |

FOREIGN PATENT DOCUMENTS

| | | | |
|---|---|---|---|
| 3-21735 | 1/1991 | Japan | 52/737.2 |
| 4-68152 | 3/1992 | Japan | 52/79.1 |

*Primary Examiner*—Carl D. Friedman
*Assistant Examiner*—Winnie S. Yip
*Attorney, Agent, or Firm*—Gary M. Gron

[57] ABSTRACT

A generator set housing has a skeletal frame with corners which conform to ISO standards. The frame members are welded together and are held in position during welding by tanging and wedging. This allows the frame to be self-squaring which eliminates the need for the use of jigs to hold the frame the together during welding. The skeletal frame is covered by panels which provide access to the generator set for service and repair. The panels are held in place by self drill and tap screws which are inserted from within the housing and would also be released from within the housing in order to enable removal of the panels. Folded sections are used throughout the housing. The dimensional accuracy is much greater due to the use of laser cutting to form the blanks from which the folded sections, including the tongues, which are integral, and the mating slots, were produced.

10 Claims, 8 Drawing Sheets

FABRICATED STRUCTURE, ESPECIALLY A HOUSING FOR A GENERATOR SET, AND A METHOD OF FABRICATING SUCH A STRUCTURE

TECHNICAL FIELD

This invention relates to a fabricated structure and more particularly, although not exclusively, to a housing for a generator set. This invention also relates to a method of manufacture of such a fabricated structure.

BACKGROUND ART

U.S. Pat. No. 3,717,964 is concerned with a framework for a module of a modular building. The framework is an assembly of beams of high strength steel. The beams may be angle beams or channel section beams. Channel section cross beams are joined at either end to a respective one of a pair of spaced parallel peripheral beams to complete a frame unit which serves as a wall, a roof or floor frame unit. Each joint is formed by butting the respective end of a cross beam against a corresponding stop formed in the peripheral beam to position the cross beams without using any jigs to establish their positions. The cross beams are held so positioned, until finally welded to the peripheral beams, by resilient prongs formed in the respective peripheral beams and over which the cross beams were forced with a snap action, against the resilience of the prongs, in being brought into abutment with the stops. Each stop and each prong is formed in each beam by punching in a press which may be an NC press. After each beam has been formed, it is passed through the press whereupon the stops and prongs are formed by punching between dyes. Relatively thin gauge material must be used for forming the beams since the prongs will be too stiff and it will not be possible to force the ends of the cross beams passed them unless they are formed of a relatively thin gauge material.

U.S. Pat. No. 1,970,965 is concerned with beams which are I-beams which would be extrusions or forgings and it teaches the use of a tongue and wedge joint to temporarily join two such I-beams together prior to final welding. It suffers from the shortcoming that the tongues are separate parts welded to the beams. There are bound to be inaccuracies due to the welding and this is catered for in the design of the respective slot.

An object of this invention is to provide a fabricated structure which can be constructed easily and at reduced cost compared with conventional structures of similar kind and which avoids the problems discussed above with reference to U.S. Pat. No. 1,970,965 and U.S. Pat. No. 3,717,964 and which specifically enables use of a heavier gauge material than is possible using the teachings of U.S. Pat. No. 3,717,964.

DISCLOSURE OF THE INVENTION

According to one aspect of this invention there is provided a fabricated structure comprising a skeletal framework of elongate load bearing members joined one to another so as to form openings therebetween, and closure members which are fitted into the openings to close them, the closure members not being designed to provide structural support to the structure, wherein each elongate load bearing member is pre-formed with precision and each of certain joints of the framework between such precisely pre-formed load bearing members is made by a respective mechanical fixing arrangement which holds the pre-formed members in a precise relative location and orientation, one with respect to the other, each said certain joint being reinforced by bonding to provide structural strength at the joint, the arrangement being such that the pre-formed members which are joined one to another by said certain joints are precisely located one relative to the other for bonding by an assembly of the respective joint and without the aid of an external jig, whereafter the respective structural bond is formed, each elongate load bearing member being pre-formed by folding from a blank which was cut with precision from sheet metal and a mechanical fixing arrangement at each said certain joint of the framework comprises a tongue and wedge joint, wherein each tongue of such a joint was formed in the act of precision cutting of the respective blank so that the tongue is formed integrally with and projects from one end of the remainder of the respective elongate load bearing member in the direction of elongation of that member.

According to another aspect of this invention there is provided a method of manufacturing the above described fabricated structure including the steps of:

(i) cutting a blank from sheet metal for each elongate load bearing member of the skeletal framework of the structure that is to be fabricated, each blank being the developed form of the respective load bearing member, including any tongue which extends from an end and any slot with which a tongue of another load bearing member is to mate at a certain joint between those two members;

(ii) folding each blank to form the respective load bearing member;

(iii) assembling the skeletal framework including making each such certain joint in the framework by fitting an integral tongue formed on one of the load bearing members to be joined by that certain joint into a mating slot formed in the other load bearing member to which the respective load bearing member is to be joined by that certain joint, and locking the tongue in the mating slot by mechanical fixing means whereby the members joined by said certain joint are correctly and accurately located relative to one another so that the skeletal framework is accurately assembled with precision in its required form without need for an external jig;

(iv) bonding the members together at each such certain joint formed by the tongues and mechanical fixing means whereby to reinforce the joint and to provide structural strength; whereafter (v) the openings formed by the elongate load bearing members of the skeletal framework are filled by respective closure means.

BEST MODE FOR CARRYING OUT THE INVENTION

Figure 1:
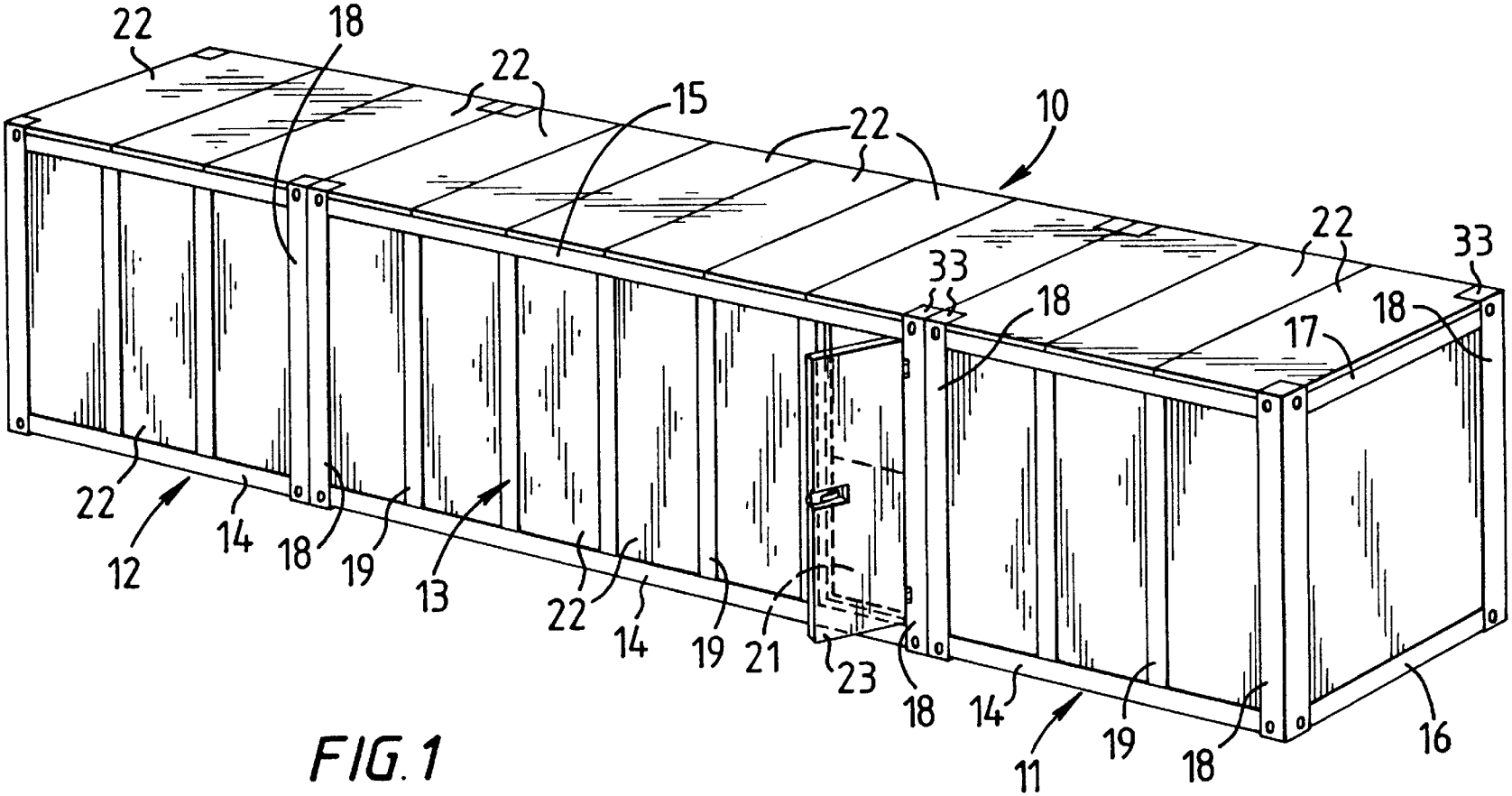
FIG. 1 shows one of the housings fitted with removable panels and a door which is shown open, the housing being extended at either end by a shorter housing module of similar construction.
Figure 2:
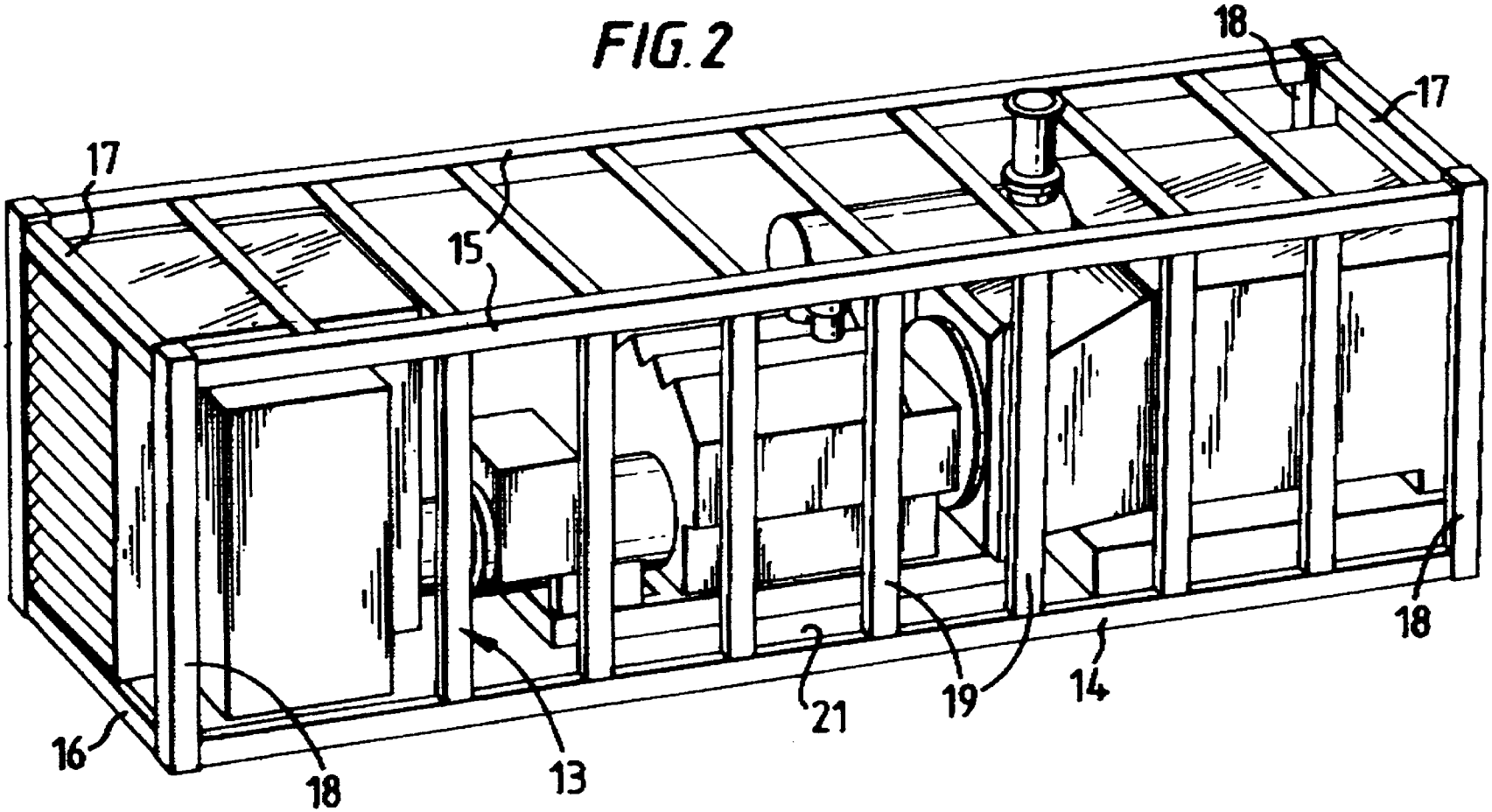
FIG. 2 is a view in perspective of a generator set installed within a framework of another of the fabricated housings.

FIG. 1 shows a generator set housing 10 which is extended at either end by a shorter module 11,12 of similar construction. The basic housing 10 comprises a skeletal framework 13. The framework 13 is formed of vertical and horizontal elongate members 19; which are joined together to form rectangular openings. Each of the openings is closed by a respective closure member which may be a floor plate 21, a removable side wall or roof panel 22 which may be an acoustic panel or a service panel, a single door 23 or a double door, a louvre, a damper, a power cable link box, a cable chute, or a lighting, fuel feed or oil drain chamber (all not shown). FIG. 2 shows a generator set housed within a similar skeletal framework 13 which differs from that shown in FIG. 1 by having seven vertical members 19 instead of five, as shown in FIG. 1, and from which the closure members have been removed.

The framework 13 comprises a vertical corner post 18 at each corner. The corner posts 18 are interconnected at the top and bottom by horizon beams 14 to 17 having a C-section. The openings of the C-section beams 17, face inwardly. Each C-section beam 14 to 17, has a locating tang 31 (see FIG. 10 for arrangement of beam 15) formed with precision at either end so as to project from it generally in a direction which is parallel to the longitudinal axis of the respective beam 14 to 17. The tangs are fitted into mating slots 24 (see FIG. 10) which are accurately formed in the respective corner post 18 whereby the beams 14 to 17, are accurately located.

Figure 3:
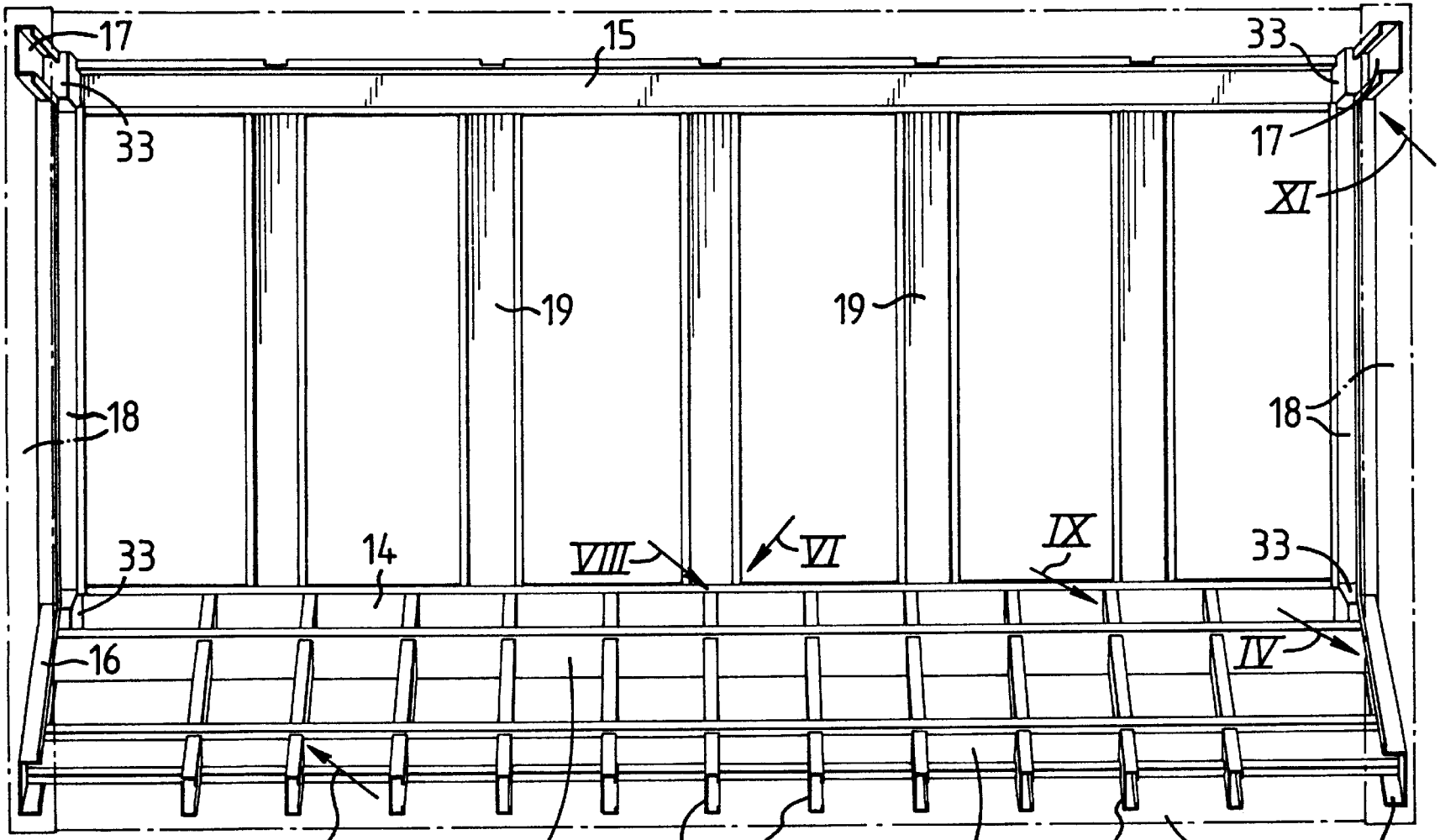
FIG. 3 is a perspective view showing the framework of one side, the ends and the floor during fabrication of the housing that is shown in FIG. 1.
Figure 4:
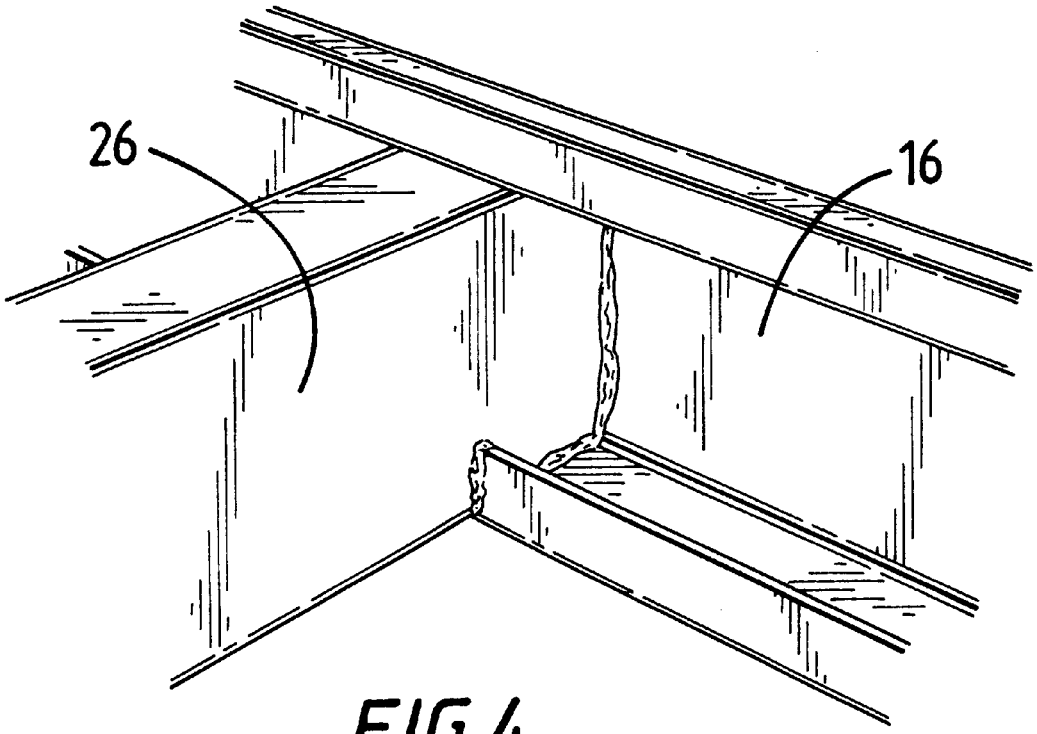
FIG. 4 shows an end of a generator set support rail welded to an end part of the peripheral base of the housing as seen in the direction of arrow IV in FIG. 3.
Figure 5:
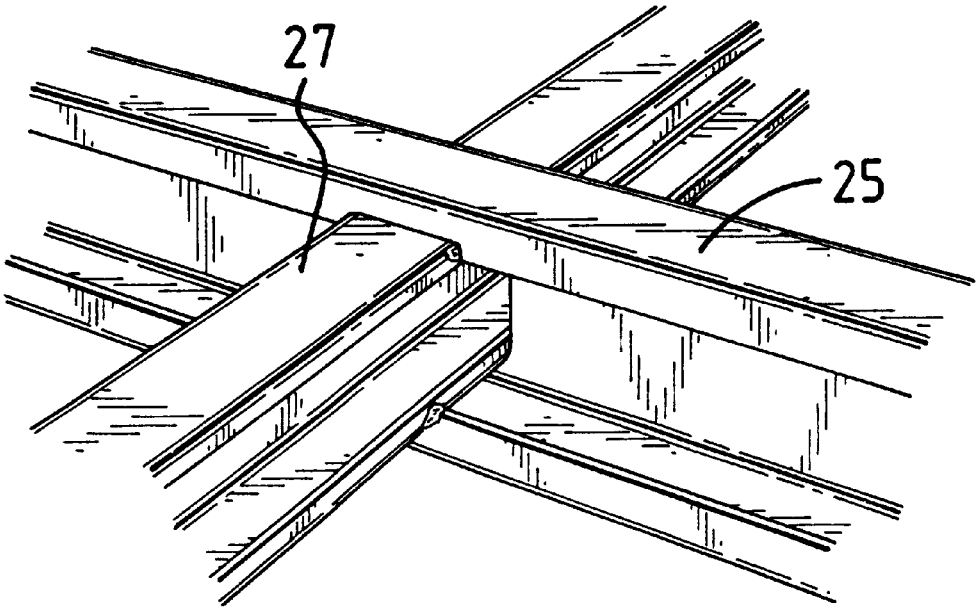
FIG. 5 is a perspective view along arrow V in FIG. 3 of a floor cross joist extending through a generator set support rail which forms part of the housing.
Figure 8:
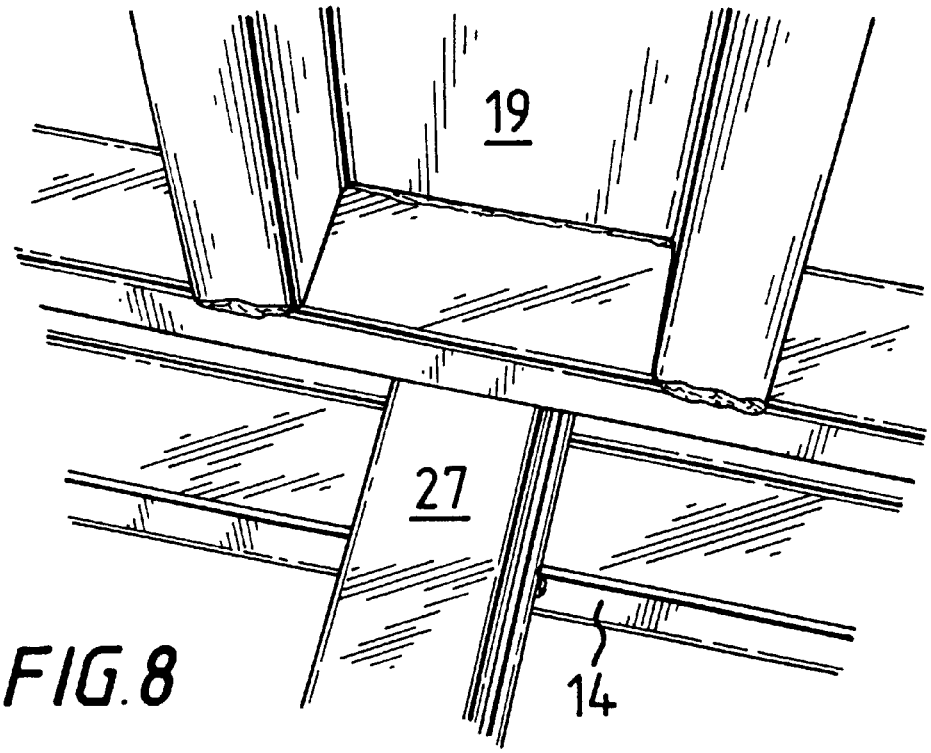
FIG. 8 is a view of the joint shown in FIGS. 6 and 7 after a floor cross-frame joist has been fitted to it, the view being along arrow VIII in FIG. 3 which is from within the housing and from above the joist.
Figure 9:
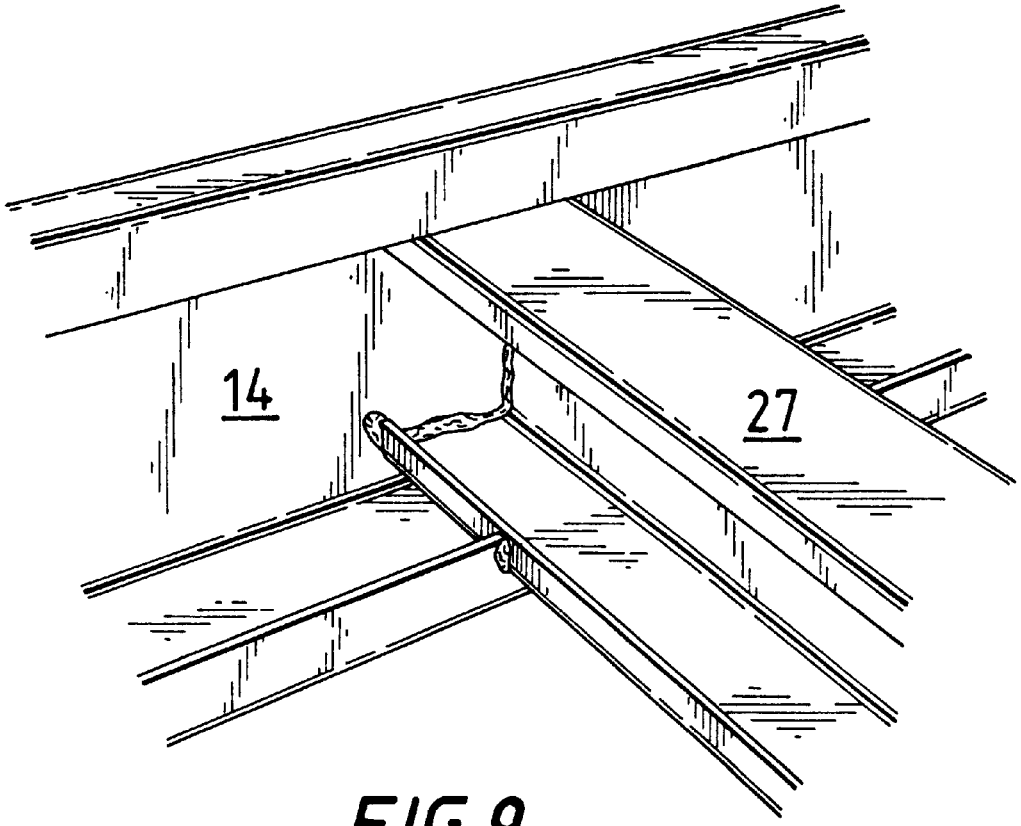
FIG. 9 is a view along arrow IX in FIG. 3 showing an end of the joist welded to the peripheral base structure of the housing.

FIG. 3 shows that the support structure for the floor plates 21 of FIGS. 1 & 2 comprises the rectangular peripheral frame that is formed by the two lower side beams 14 and the two lower end beams 16 which are bonded or welded together at the corners of that rectangular frame. Two C-section longitudinal rails 25 and 26 are welded at either end to the respective lower end beam 16 (see FIG. 4 for beam 26). The floor area is divided into three rectangular area portions by the rails 25 and 26, the mid-area portion being wider than each of the outer two area portions. A number of laterally extending floor joists 27, which have a C-section, are welded at either end to the respective lower side beam 14 and pass through respective C-shaped apertures 25*a* formed in the web of the longitudinal rails 25 and 26 (see FIG. 5). Flange portions of the C-shaped beams 14 to 17 and of the longitudinal rails 25 and 26 are cut away to provide space for the laterally-extending joists 27, as can be seen in FIGS. 5, 8 and 9. The three floor area portions are covered by the floor plates 21 which are welded in position over the joists 27.

Figure 6:
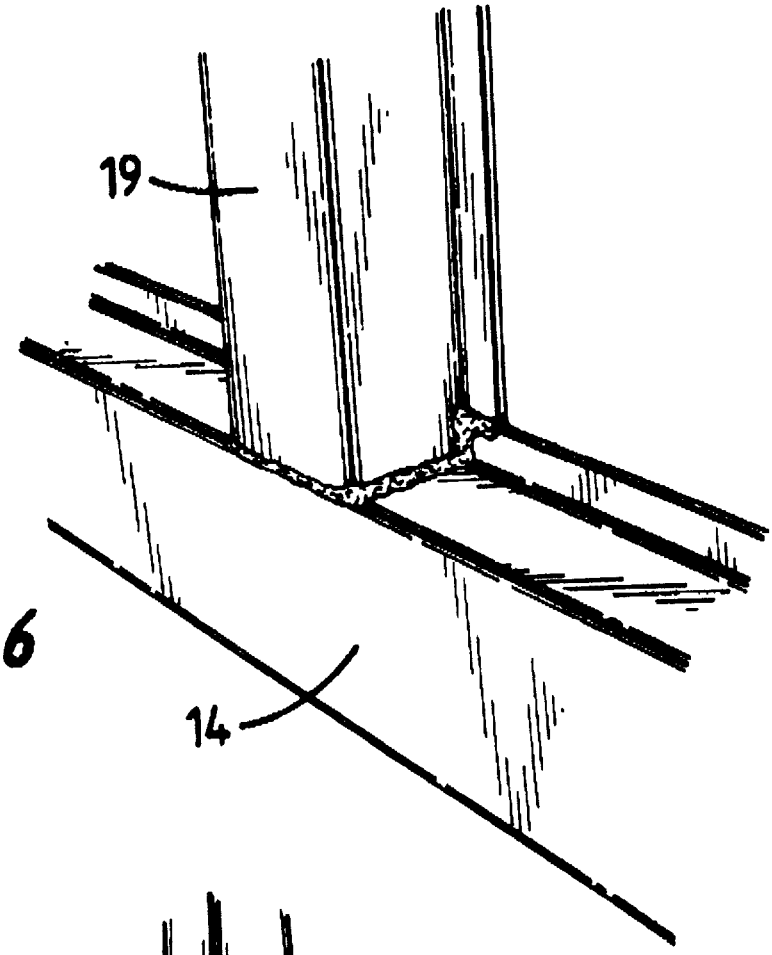
FIG. 6 is a perspective view along arrow VI in FIG. 3, which is from outside the housing, of an exemplary joint between an upstanding post or mullion and structure at the periphery of the base of the housing during its fabrication.

Each side wall of the skeletal framework 13 comprises the respective upper and lower C-section side beams 14 and 15 and the respective corner posts 18 that they interconnect. A number of spaced upstanding posts or mullions 19 are fixed at their top and bottom respectively to the respectively upper or lower side beam 14,15 (see FIGS. 6, 7 and 8) at spaced intervals along that beam 14,15 between the respective corner posts 18 (see FIG. 3). The joint between each mullion 19 and the respective upper or lower side beam 14,15 at both the top and the bottom of the mullion 19 comprises a tongue and wedge 31*a* formed from sheet material which extends through slot 31*b* in tongue 31. The resulting joint (see FIG. 7) is reinforced by welding (see FIG. 6).

The corner posts 18, the upstanding posts or mullions 19 of each side wall and the side and end beams 14 to 17 are formed by accurately cutting blanks with precision from sheet metal by a CNC laser cutting machine and then folding the blanks into their respective cross-section. The blanks for the corner posts 18, the mullions 19 and the beams 14 to 17 will be formed with the tangs 31 which are referred to above in respect of the beams 14 to 17 (except that each of the beams 14 and 15 has only one such a tang 31 at either end as is described below with reference to FIG. 10), or with similar tongues 31 (see FIG. 7) for the joints between the mullions 19 and the respective side beams 14, 15, and with precisely formed and located slots 24 (see FIG. 10) for locating such tangs 31 or with similar precisely formed and located slots for the tongues 31 when the respective tangs or tongues 31 are fitted therein.

Each mullion 19 has a top hat section. When fitted to the respective side beams 14 and 15, the mullions 19 are orientated so that their flanges are inboard with respect to the housing 10, the bulk or remainder of each mullion 19 being disposed outwardly relative to its flanges and with respect to the interior of the housing 10.

Figure 10:
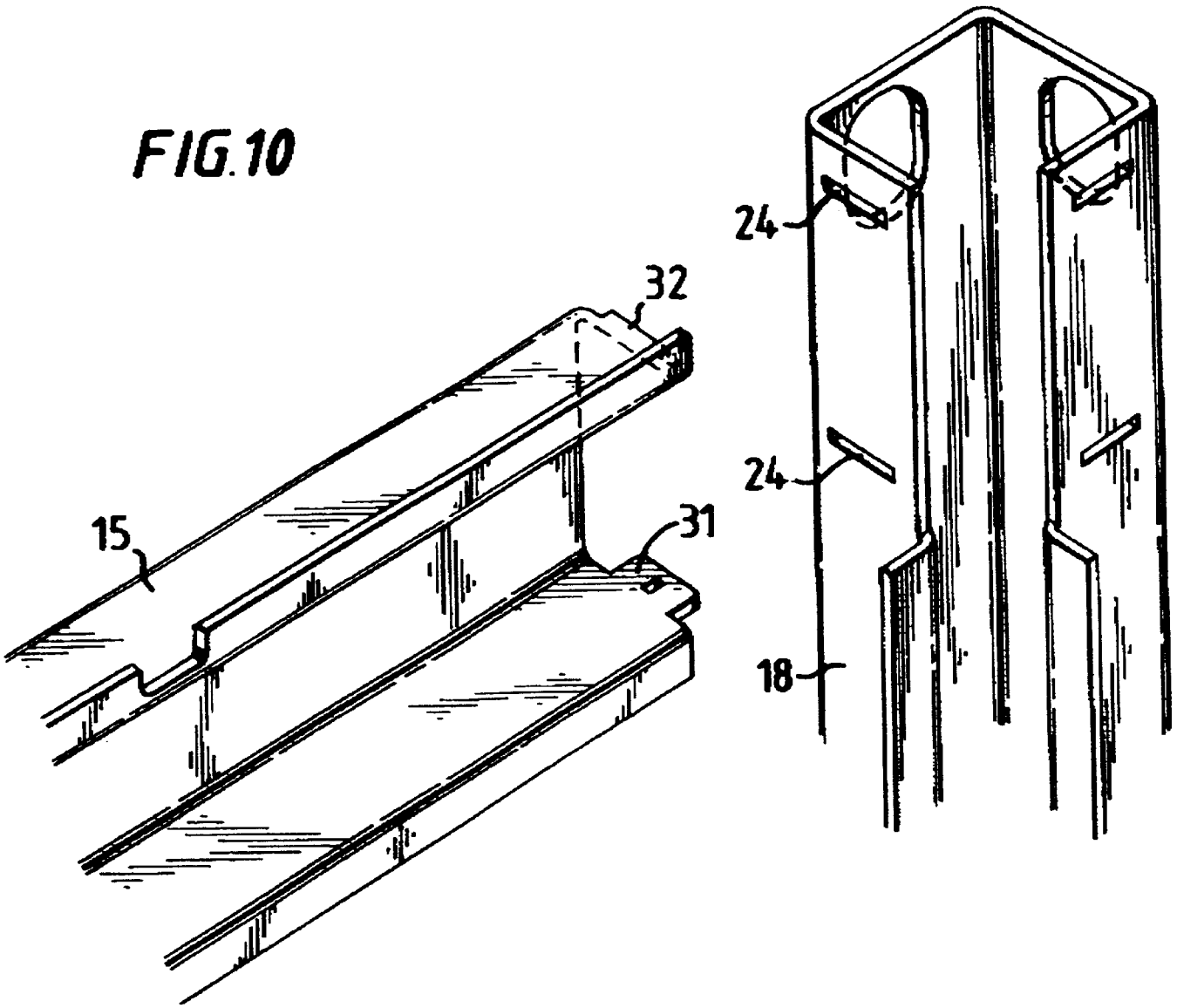
FIG. 10 shows a preformed horizontal beam formed by folding a blank and a preformed corner post formed by folding a blank, the beam and corner post to be connected together at an upper corner of the housing during assembly of the housing as shown in FIG. 3.

FIG. 10 shows that the cross-section of each corner post 18 comprises an open figure which is a partial box-section. It is approximately three quarters of a closed box section (one corner of the equivalent box-section and part of each side leading to that corner being omitted) and it has mutually perpendicular outwardly projecting flanges at each end, each flange being substantially parallel to a respective one of the full sides of the box. The corner posts 18 are arranged with their openings facing into the interior of the skeletal framework 13 so that each flange of each corner post 18 is either generally in the plane of the respective side wall or generally in the plane of the respective end of the housing 10 as appropriate and in each case the flange is spaced inwardly with respect to the outer surface of the housing 10. The flanges of the corner posts 18 that are generally in the plane of the side walls are substantially co-planar with the flanges of the mullions 19 of that side wall of the skeletal framework 13.

Figure 11:
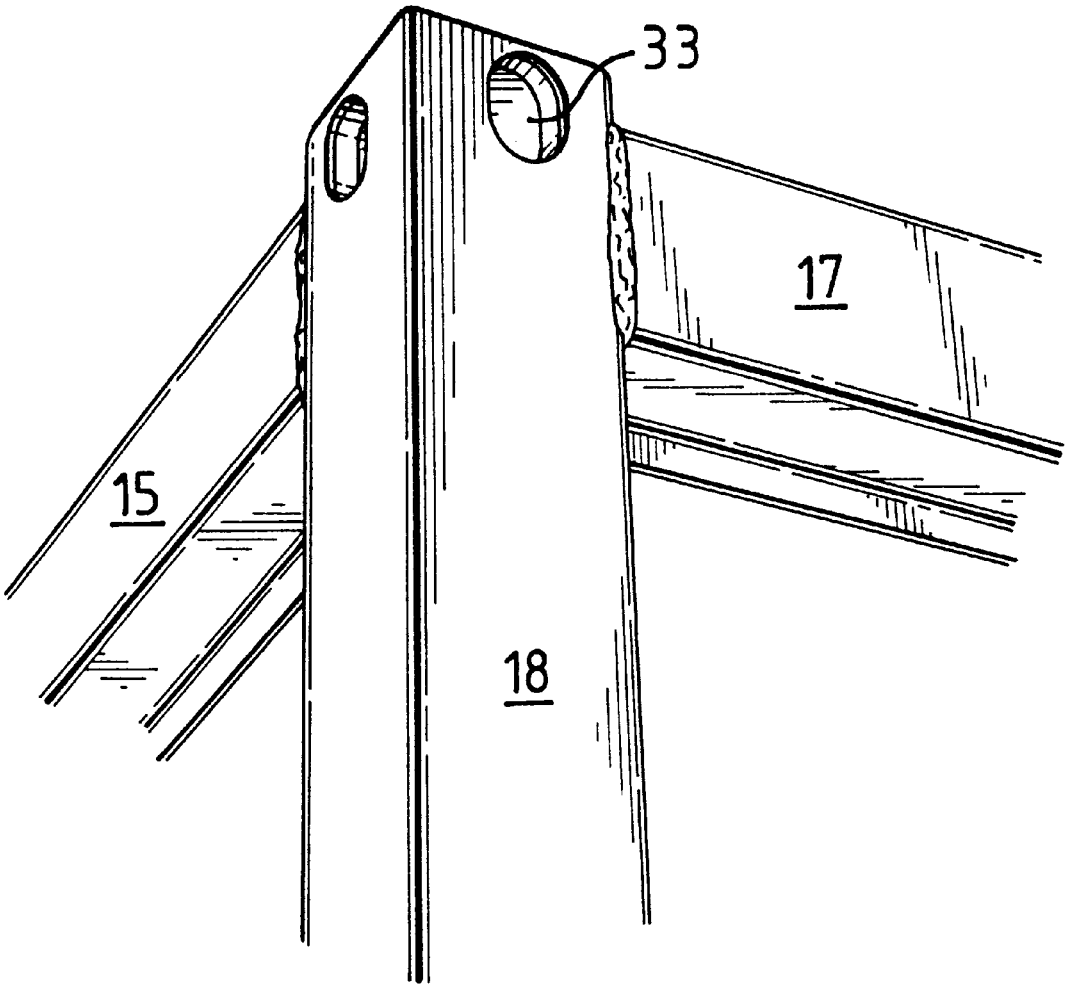
FIG. 11 shows a standard corner block fitted at an upper end corner of the framework of the housing.

A standard corner block 33 is fitted into the partial box section cavity of each corner post 18 at both the top as is shown in FIG. 11 and the bottom. Each block 33 closes off the inner end of the slot 24 that is nearest to the respective top or bottom end of the respective corner post 18. Therefore the tang 32 that is formed at the respective end of the respective beam 14, 15 for engagement in each closed off slot 24, is shorter than the other tangs or tongues 31, its length being just sufficient for it to be located in the respective slot 24 that is closed off at its inner end by the respective corner block 33.

The removable panels 22 are fitted into the respective openings in the side wall or the roof so that they seat upon the flanges of the juxtaposed mullions 19 on either side of the opening, or in the case of an opening at an end of the housing 10, on the flanges of the corner post 18 and the juxtaposed mullion 19 at that end. The depth of each panel 22 is substantially the same as the depth of the channel section mullions 18 so that the outer surfaces of the panels 22 are flush with the remainder of the outer surfaces of the side walls. Each panel 22 is releasably fixed in position by self-tapping screws which are screwed into the material of the respective panel 22 through holes formed in the flanges on which they are seated, the screws being inserted from inside the housing 10. Panels in the roof or elsewhere which are not to be removable may be welded in position.

The sidewalls and the roof may be clad with additional outer panels to provide improved sound attenuation. Such panels in the roof may be spaced from one another to form laterally extending drainage channels between them.

Figure 7:
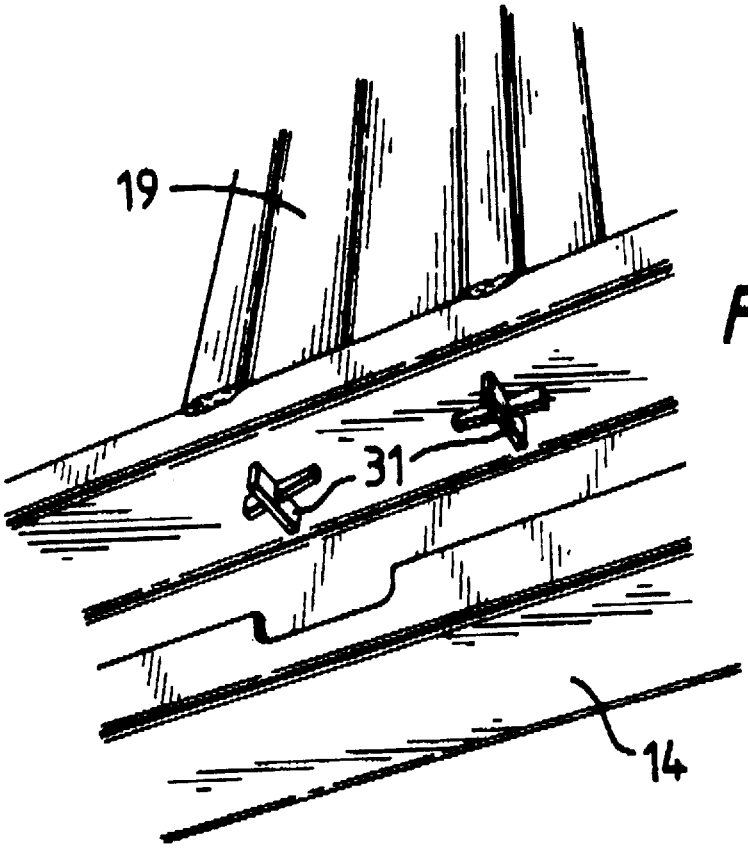
FIG. 7 is a perspective view of the joint shown in FIG. 6 as seen from within the housing in a direction opposite to the direction of arrow VI in FIG. 3.

The skeletal framework 13 is assembled by selecting the side and end beams 14 to 17, and the corner posts 18 and the mullions 19 that are required. One side wall would be assembled first by fitting the tangs 31 and 32 at either end of the upper and lower side beams 14 and 15 into the respective slots 24 that had been formed with precision in the respective corner posts 18. Also, the mullions 19 would have been fitted between the upper and lower side beams 14 and 15 by inserting the respective tongue 31 at the upper and lower ends of each mullion 19 into the mating slot formed with precision in the respective upper and lower side beam 14,15, and inserting the respective wedge 31a in position as shown in FIG. 7. Once all the elements of the side wall had been assembled and were in position, the various wedges 31*a* would be hammered in to tighten up the joints. The use of tanging and wedging in this way simplifies construction and reduces operator error as compared with conventional assembly techniques. This concept in combination with the use of structural elements which have been formed by cutting as blanks from sheet material with a highly accurate CNC laser cutting machine and then folded to their final form, also increases accuracy and leads to the assembly being self-squaring and dimensioning.

Having formed one side wall portion of the framework 13, it is supported upright as shown in FIG. 3, whereupon the central rails 25 and 26 and the laterally extending cross-joists 27 are assembled to form the floor, again as shown in FIG. 3. The second side wall is formed and erected in the same way as the first one and the skeletal frame 13 is completed by fitting the upper end beams 17 in position to interconnect the side walls at their upper ends. As a result, the elements of the skeletal frame 13 are assembled in their correct relatively square locations, whereafter all the joints are reinforced by welding. The technique of forming joints using tonguing and wedging to square up the various elements of the sub-assemblies and then reinforcing each joint by welding is used throughout construction of the skeletal frame.

The various closure members, namely the removable panels 22, doors 23 and other service panels are installed to close the various rectangular openings of the skeletal frame 13 once fabrication of the skeletal frame 13 has been completed. The housing 10 is then prepared for installation of a generator set (see FIG. 2) which will be supported on the two longitudinally extending central rails 25 and 26 in the floor. Conveniently, one of the closure members or panels may be a door. The closure members or panels may additionally or alternatively comprise an acoustic wall or roof panel, acoustic attenuators, louvres, dampers or service panels including power cable link boxes and cable chutes. Also the hollow interior of such posts formed by folding from sheet metal may accommodate lighting, fuel feed and oil drain chambers.

Conveniently, any handles for doors of the housing are recessed and there may be slam lock fasteners and release mechanisms operable from inside. Moreover, any hinges could be concealed within the frame posts.

The dimensions of the housing 10 discussed above with reference to and as shown in the various drawings are substantially the same as those of a standard ISO freight container. For that reason, it is provided with the standard blocks 33, whereby it can be suspended from a crane hook for lifting and manoeuvring. Although the housing 10 does not necessarily comply with all the regulatory requirements for a standard ISO freight container, several of such housings can be stacked one upon the other. Also, the housing may be of any convenient size, indeed it could be considerably smaller. The dimensions of the removable panels 22 in each side wall of the described embodiments vary. They may be of the order of 2500 mm high and about 800 mm±75 mm. The sheet metal used in this embodiment is 5 mm plate but the gauge used would be chosen having regard to the loading to which the component would be subjected.

In general, the housing has a skeletal frame with corners which may conform to ISO standards, wherein the frame members are positioned to form openings suitable to allow access to areas of the generator set housed within it. The frame members are welded together and are held in position during welding by tanging and wedging. Certain of the frame members have tangs on their ends which fit into mating apertures or slots in other frame members. A wedge is inserted between the tang and the other member in which the mating slot was formed and driven in to tighten up the respective joint thereby preventing the tang from being withdrawn. As stated above, this tanging and wedging allows the frame to be self-squaring which eliminates the need for the use of jigs to hold the frame together during welding. The skeletal frame is covered by removable panels which provide access to the generator set for service and repair. The panels themselves provide no structural support to the housing and are held in place by self drill and tap screws which are inserted from within the housing and would also be released from within the housing in order to enable removal of the panels.

Folded sections are used throughout the design of the housing. This allows greater flexibility to incorporate features into the various sections, for example, hinge pockets, emergency stop box, fuel entry box, and the internal standard corner block. The void space of the sections allows for routing of cables and other services. Such a folded section is better in appearance than proprietary box sections and is more cost effective. The dimensional accuracy is much greater due to the use of laser cutting to form the blanks from which the folded sections were produced.

Use of removable side panels allows easy access for servicing of the generator set. The panels are quickly fastened and compliment the access given by the door. The attenuation level is varied by selection of an acoustic material and/or thickness of material. The panels have large surface areas which may provide the location for advertising logos and are aesthetically pleasing. Should panels become damaged on site, they can easily be replaced.

The multiple panel concept allows for flexibility of door position and handing of the door, which in turn will conveniently be flush with the remainder of the side walls of the housing. Double doors can be incorporated into the housing if required. Both door latch and door hinges would be recessed.

Having thus described the invention, what is claimed as novel and desired to be secured by Letters Patent of the United States is:

1. A fabricated structure comprising a skeletal framework of preformed elongate load bearing members joined one to another at certain joints so as to form openings therebetween, and non load bearing means for closing said openings, and a mechanical fixing arrangement for holding the pre-formed members in a precise relative location and orientation, one with respect to the other, and means for reinforcing each said certain joint by bonding to provide primary structural strength at each such certain joint, said mechanical fixing arrangement at each said certain joint of the framework comprising a tongue projecting from one end of a respective elongate load bearing member through a slot formed in the adjacent elongated member, said tongue having a slot, and a wedge received in the slot formed in said tongue, whereby the preformed elongated members are precisely located one relative to the other for said reinforcing means without the aid of an external jig.

2. A fabricated structure according to claim 1, wherein the tongue of each elongate load bearing member is integral with such elongate load bearing member.

3. A fabricated structure according to claim 2, for housing a generator set, said means for closing said openings comprising removable panels for providing access to the generator set for maintenance and repair.

4. A fabricated structure according to claim 3 further comprising means for releasably securing such removable panels to the respective load bearing members from within the interior of the housing within which the generator set is to be located.

5. A fabricated structure according to claim 4, wherein each elongate load bearing member to which the removable panels are releasably secured further comprises a lateral flange projecting from either side towards the other of the pair of members to which the releasable panel is secured, each load bearing member positioned outwardly from the respective lateral flange with respect to the interior of the enclosure.

6. A fabricated structure according to claim 5, wherein each removable panel is secured to the outer face of each of the respective lateral flanges by self-tapping screws which are screwed into such removable panel from within the enclosure through the respective lateral flange.

7. A fabricated structure according to claim 5, wherein each elongate load bearing member is pre-formed into a top-hat section.

8. A fabricated structure according to claim 7, wherein said fabricated structure is in the form of a rectangular box structure, the top-hat section elongate members intermediate the corners of said box structure being posts which are upstanding from a base structure and which support a roof of the box, there being tongue and wedge joints reinforced by welding at the top and bottom of each such post, wherein the corner posts are pre-formed by folding from sheet metal so as to have an open section which is a partial box-section, one corner of the equivalent box-section and part of each side leading to the corner being omitted, each such corner post being orientated so that the opening formed by said one corner and the partial sides that are omitted, faces the interior of the structure, and wherein standard corner blocks are provided at the top and the bottom of each of the corner posts for the purpose of slinging the housing from a crane hook.

9. A fabricated structure according to claim 8, further comprising a floor structure having a pair of longitudinal rails substantially the length of said generator set housing upon which a generator set would be supported, with C-section cross members extending laterally through corresponding C-section apertures formed in each of the longitudinal rails, the C-section cross members being joined at their ends to a peripheral frame structure which forms the bottoms of the side walls and which spans the structure at the bottom at either end of the side walls.

10. A method of manufacturing a fabricated structure of a skeletal framework of elongate load bearing members when joined one to another so as to form openings therebetween and closure members to close said openings, said method comprising the steps of:

(i) cutting a blank from sheet metal for each elongate load bearing member of the skeletal framework of the structure that is to be fabricated, each blank being the developed form of the respective load bearing member, including any tongue which extends from an end and any slot with which a tongue of another load bearing member is to mate at a certain joint between those two members;

(ii) folding each blank to form the respective load bearing member;

(iii) assembling the skeletal framework including making each such certain joint in the framework by fitting an integral tongue formed on one of the load bearing members to be joined by that certain joint into a mating slot formed in the other load bearing member to which the respective load bearing member is to be joined by that certain joint, and locking the tongue in the mating slot by mechanical fixing means whereby the members joined by said certain joint are correctly and accurately located relative to one another so that the skeletal framework is accurately assembled with precision in its required form without need for an external jig;

(iv) bonding the members together at each such certain joint formed by the tongues and mechanical fixing means whereby to reinforce the joint and to provide primary structural strength; whereafter (v) the openings formed by the elongate load bearing members of the skeletal framework are filled by respective closure means.

* * * * *